US009512363B2

(12) United States Patent
House et al.

(10) Patent No.: US 9,512,363 B2
(45) Date of Patent: Dec. 6, 2016

(54) METHOD FOR EXTRACTING BITUMEN FROM AN OIL SAND STREAM

(71) Applicants: Shell Canada Energy, Calgary (CA); Chevron Canada Limited; Marathon Oil Sands L.P.

(72) Inventors: Peter Kirkwood House, Calgary (CA); Julian Robert Kift, Reno, NV (US); John Patrick Ringstrom, Calgary (CA)

(73) Assignee: Shell Oil Company, Houston, TX (US)

( * ) Notice: Subject to any disclaimer, the term of this patent is extended or adjusted under 35 U.S.C. 154(b) by 283 days.

(21) Appl. No.: 13/943,580

(22) Filed: Jul. 16, 2013

(65) Prior Publication Data

US 2014/0021103 A1 Jan. 23, 2014

(51) Int. Cl.
*C10G 1/04* (2006.01)
*C10G 1/00* (2006.01)

(52) U.S. Cl.
CPC ..... *C10G 1/045* (2013.01); *C10G 1/002* (2013.01); *C10G 1/04* (2013.01); *C10G 1/042* (2013.01)

(58) Field of Classification Search
CPC ..... C10G 1/002; C10G 1/042; C10G 1/045
See application file for complete search history.

(56) References Cited

U.S. PATENT DOCUMENTS

| | | | | | |
|---|---|---|---|---|---|
| 2,965,557 | A * | 12/1960 | Price | C10G 1/04 | 208/390 |
| 3,475,318 | A | 10/1969 | Gable et al. | 208/11 | |
| 4,036,732 | A * | 7/1977 | Irani et al. | 208/390 | |
| 4,719,008 | A * | 1/1988 | Sparks et al. | 208/390 | |
| 2008/0210602 | A1* | 9/2008 | Duyvesteyn | 208/390 | |
| 2009/0301937 | A1 | 12/2009 | Duyvesteyn et al. | 208/390 | |
| 2011/0127197 | A1* | 6/2011 | Blackbourn et al. | 208/390 | |

FOREIGN PATENT DOCUMENTS

WO WO2011021092 * 2/2011 ..... B01D 11/02

* cited by examiner

*Primary Examiner* — Renee E Robinson

(57) ABSTRACT

The present invention provides a method for extracting bitumen from an oil sand stream, the method including at least the steps of: (a) providing an oil sand stream; (b) contacting the oil sand stream with a liquid comprising a non-aqueous solvent thereby obtaining a solvent-diluted oil sand slurry; (c) screening the solvent-diluted oil sand slurry thereby obtaining a screened oil sand slurry and a rejects stream; (d) introducing the rejects stream into a liquid bath; (e) transporting the rejects stream through the liquid bath to a space above the surface of the liquid bath; and (f) extracting bitumen from the screened oil sand slurry obtained in step (c).

11 Claims, 2 Drawing Sheets

METHOD FOR EXTRACTING BITUMEN FROM AN OIL SAND STREAM

RELATED APPLICATIONS

This application claims the benefit of Canadian Application No. 2,783,269 filed Jul. 17, 2012, which is incorporated herein by reference.

BACKGROUND

The present invention relates to a method for extracting bitumen from an oil sand stream, in particular using a non-aqueous solvent. More in particular, the present invention provides a method for removing rejects from an oil sand stream.

Various methods have been proposed in the past for the recovery of bitumen (sometimes referred to as "tar" or "bituminous material") from oil sands as found in various locations throughout the world and in particular in Canada (such as in the Athabasca district in Alberta) and in the United States (such as in the Utah oil sands). Typically, oil sand (also known as "bituminous sand", "oil sand ore" or "tar sand") comprises a mixture of bitumen (in this context also known as "crude bitumen", a semi-solid form of crude oil; also known as "extremely heavy crude oil"), sand, clay minerals and water. Usually, oil sand contains about 5 to 25 wt. % bitumen (as meant according to the present invention), about 1 to 13 wt. % water, the remainder being sand and clay particles.

As an example, it has been proposed and practiced at commercial scale to recover the bitumen content from the oil sand by mixing the oil sand with water and separating the sand from the aqueous phase of the slurry formed. Disadvantages of such aqueous extraction processes are the need for extremely large quantities of process water (typically drawn from natural sources) and issues with both removing the bitumen from the aqueous phase (whilst emulsions are being formed) and removing water from the bitumen-depleted sand.

Other methods have proposed non-aqueous extraction processes to reduce the need for large quantities of process water. Examples of such a non-aqueous extraction process are disclosed in e.g. U.S. Pat. No. 3,475,318 and US 2009/0301937, the teaching of which is hereby incorporated by reference.

In non-aqueous solvent extraction processes oil sand ore is mixed with a non-aqueous solvent containing stream thereby obtaining a solvent-diluted oil sand slurry. As downstream processing equipment typically requires particles above a certain maximum size to be removed, these bigger particles (also called "rejects") are screened from this slurry.

A problem of non-aqueous solvent extraction of bitumen from oil sand is that any rejects being removed from the slurry need to be discharged to the atmosphere. Hence, the (non-aqueous) solvent content in the rejects needs to be reduced to a sufficiently safe level before the rejects can be exposed to the atmosphere. This problem is in particular pertinent in case a volatile solvent is used for the extraction of bitumen.

A further problem of non-aqueous solvent extraction of bitumen from oil sand is the provision of an effective seal between the usually slightly pressurized (typically volatile hydrocarbon) solvent processing environment and the atmosphere, to prevent the venting to the atmosphere of the non-aqueous solvent (vapours) as used for extracting bitumen from oil sand. Transporting rejects through such a seal is a technically challenging operation.

Typical examples of equipment used for such solids transport operations are rotary star valves, lock hopper systems and the like. However, the nature of the rejects as obtained in an oil sands solvent extraction process, in which relatively large rocks can be present, cause significant issues in designing an economic, reliable and low-maintenance system, in particular whilst avoiding the venting of the non-aqueous solvent to the atmosphere.

It is an object of the present invention to solve or at least minimize these problems.

It is a further object of the present invention to provide a method that allows for the integration of the removal of solvent and bitumen from rejects and the transporting of these rejects through a seal between the hydrocarbon processing environment and atmosphere.

SUMMARY OF THE INVENTION

One or more of the above or other objects may be achieved according to the present invention by providing a method for extracting bitumen from an oil sand stream, the method comprising at least the steps of:

(a) providing an oil sand stream;
(b) contacting the oil sand stream with a liquid comprising a non-aqueous solvent thereby obtaining a solvent-diluted oil sand slurry;
(c) screening the solvent-diluted oil sand slurry thereby obtaining a screened oil sand slurry and a rejects stream;
(d) introducing the rejects stream into a liquid bath;
(e) transporting the rejects stream through the liquid bath to a space above the surface of the liquid bath; and
(f) extracting bitumen from the screened oil sand slurry obtained in step (c).

It has now been found that the method according to the present invention provides a surprisingly simple, safe and elegant manner to transport and remove rejects, as generated during a process for extracting bitumen from an oil sand stream using a non-aqueous solvent, whilst avoiding the venting of non-aqueous solvent to the atmosphere during the treatment and removal of rejects.

An important advantage of the present invention is that a reliable seal is created by the liquid bath between the solvent processing environment and the atmosphere. This seal results in a significant safety improvement, as the risk of the creation of explosive conditions is reduced.

According to the present invention, the providing of the oil sand stream in step (a) can be done in various ways. Typically, the oil sand is first reduced in size, e.g. by crushing, breaking and/or grinding, to below a desired size upper limit. Preferably, the oil sand provided in step (a) has a particle size of less than 20 inches, preferably less than 16 inches, more preferably less than 12 inches.

In step (b), the oil sand stream is contacted with a liquid comprising a non-aqueous solvent thereby obtaining a solvent-diluted oil sand slurry.

The non-aqueous solvent (as intended for extraction of bitumen from oil sand) is not limited in any way. Preferably, the non-aqueous solvent is a hydrocarbon solvent such as an aliphatic or aromatic hydrocarbon solvent, preferably an aliphatic hydrocarbon solvent. The aliphatic (i.e. non-aromatic) solvent may be any saturated or unsaturated aliphatic solvent and may include linear, branched or cyclic alkanes and alkenes and mixtures thereof. Preferably, the non-aqueous solvent comprises an aliphatic hydrocarbon having from 3 to 9 carbon atoms per molecule, more preferably from 4 to 7 carbons per molecule, or a combination thereof. Especially suitable solvents are saturated aliphatic hydrocarbons such as propane, butane, pentane, hexane, heptane, octane and nonane, in particular butane, pentane, hexane and heptanes (and isomers thereof). It is preferred that the non-aqueous solvent comprises at least 90 wt. % of the aliphatic hydrocarbon having from 3 to 9 carbon atoms per molecule, preferably at least 95 wt. %. Also, it is preferred that substantially no aromatic solvent (such as toluene or benzene) is present in the non-aqueous solvent, i.e. less than 5 wt. %, preferably less than 1 wt. %. Preferably, the liquid comprising the non-aqueous solvent comprises at least 50 wt. %, preferably at least 80 wt. % and more preferably at least 90 wt. % or even 100 wt. %, of the non-aqueous solvent.

In step (c), the solvent-diluted oil sand slurry is screened thereby obtaining a screened oil sand slurry and a rejects stream. As the person skilled in the art readily understands how the screening can be performed, this is not further discussed here.

The rejects stream is the part of the solvent-diluted oil sand slurry that does not fit through the openings in the one or more screens used in the screening of step (c) and typically contains undesired materials (such as rocks, clay lumps and woody material) that may hinder downstream processing. Preferably, the rejects stream as obtained in step (c) has a particle size of above 5 mm (although a minor amount such as less than 5 vol. % of the rejects stream may have a smaller size), preferably above 10 mm, and typically below 500 mm.

In step (d), the rejects stream is introduced into the liquid bath. To this end, the rejects stream will typically fall through a chute into the liquid bath, but other ways of introduction (such as by means of a conveyor belt) may be used as well. The liquid in the liquid bath is not limited in a specific way and can be selected from a wide range of liquids or combinations thereof. Non-limitative examples of the liquid are water, a hydrocarbon, dilbit (diluted bitumen), diesel, a heavy industrial solvent, etc., and combinations thereof. Preferably, the liquid in the liquid bath comprises a compound selected from the group consisting of water and a hydrocarbon having a flash point (preferably as determined according to ASTM E2079) that is above the operating temperature of the liquid bath, or a combination thereof; more preferably the liquid is water. The hydrocarbon having a flash point that is above the operating temperature of the liquid bath may be any saturated or unsaturated aliphatic (i.e. non-aromatic) and aromatic hydrocarbon, and may include linear, branched or cyclic alkanes and alkenes and mixtures thereof. Typically, the hydrocarbon having a flash point that is above the operating temperature of the liquid bath is an aliphatic hydrocarbon having at least 10 carbon atoms per molecule.

Preferably, the liquid bath comprises at least 50 wt. %, more preferably at least 80 wt. % and even more preferably at least 90 wt. % or even 100 wt. %, of water or said hydrocarbon having a flash point that is above the operating temperature of the liquid bath.

Preferably, the liquid bath has a temperature of above the atmospheric boiling point of the non-aqueous solvent. In this respect it is noted that the non-aqueous solvent referred to here is the solvent as used for the extraction of bitumen from the oil sand ore; the liquid bath may (although it preferably contains water) in principle also contain a hydrocarbon, but the latter would then typically be less volatile than the non-aqueous solvent and (as mentioned above) e.g. be an aliphatic (or aromatic) hydrocarbon having at least 10 carbon atoms per molecule. Generally, the liquid bath typically has a temperature from 20 to 150° C.; in case the non-aqueous solvent is pentane, the liquid bath typically has a temperature from 40 to 100° C., preferably above 60° C. and preferably below 95° C. This will help in removing any residual non-aqueous solvent still present on the rejects, as this residual non-aqueous solvent will vaporize by the heat of the liquid bath and rise through the liquid bath. Through proper configuration and dimensioning of the liquid bath, this solvent vapour may be directed to end up at the side where the oil sand stream is contacted (in step (b)) with the liquid comprising the non-aqueous solvent (e.g. in the confined space as mentioned hereinafter). Experiments with a hot water bath have shown that bitumen dissolved in the residual non-aqueous solvent may also be disengaged from the rejects. Several weirs may be used in the liquid bath to promote the non-aqueous solvent and bitumen to flow to the desired locations and separate them from the cleaned rejects exiting the liquid bath. If desired, steam may be introduced into the liquid bath to provide heat and aid in the vaporisation of the residual non-aqueous solvent.

By using a liquid bath having a temperature of above the atmospheric boiling point of the non-aqueous solvent, the liquid bath provides a reliable seal for the non-aqueous solvent (not to be vented to the atmosphere) and also integrates this sealing function with the operation to remove bitumen and non-aqueous solvent from the rejects thereby combining multiple process steps in one and hence reducing cost and complexity as compared to the situation wherein bitumen is removed from the rejects upstream of the liquid bath by washing the rejects with clean non-aqueous solvent on for example a rotating or vibrating screen and subsequently removing the non-aqueous solvent by purging with steam and/or $N_2$ in a separate unit such as a rotating dryer.

Preferably, the non-aqueous solvent is at least partially removed from the rejects stream, before entering the rejects stream into the liquid bath in step (d). This can for example be done by heating the rejects stream to strip off the non-aqueous solvent, by purging with $N_2$ and/or steam, etc.

In step (e), the rejects stream is transported through the liquid bath to a space above the surface of the liquid bath; this space above the surface of the liquid bath is typically the atmosphere, but may be a confined space instead. Typically the transporting is done using one or more suitable transporting devices such as a belt/apron-type conveyor, an enclosed Cambelt or Camwall conveyor, a submerged drag chain conveyor, a screw conveyor, a mechanical ram/pusher conveyor, etc. If desired, some kind of stirring or moving of the rejects in the liquid may be performed in the liquid bath. After leaving the liquid bath, the rejects are typically subjected to downstream processing or simply disposed of. The rejects may simply drop from the transporting device into a feeder to such downstream processing. Preferably, the rejects are drained first to remove superfluous liquid as entrained whilst transporting through the liquid bath before being subjected to such downstream processing or disposal.

Preferably, in step (e) the rejects stream flows underneath a weir during the transporting through the liquid bath. Typically, this weir is partially submerged in the liquid bath. As mentioned above, several weirs may be present in the liquid bath, for example to promote the non-aqueous solvent and bitumen to flow to the desired locations and separate them from the cleaned rejects exiting the liquid bath. Alternatively, the functionality of the one or more weirs may be provided by appropriate design of the geometry of the liquid bath.

Further it is preferred that in step (e) the rejects stream is transported in an upwards direction. In this embodiment, the rejects stream is introduced in the liquid bath and allowed to sink to a lower part of the liquid bath and subsequently transported upwards towards the space above the surface of the liquid bath. Alternatively, the rejects stream is transported in a substantially V-shaped or U-shaped direction.

According to a preferred embodiment of the present invention, the rejects stream is introduced in the liquid bath in step (d) from a confined space. The person skilled in the art will readily understand what is meant by a "confined space"; it is meant to indicate that substantially no gases can enter the confined space, other than fed into the confined space on purpose. In this case, the liquid bath provides a seal between the space as meant in step (e) (which is typically the atmosphere) and the confined space; no free exchange of gases is possible between the space and the confined space (but of course gases such as purge gas may be fed on purpose into the confined space). In one embodiment, the above-mentioned weir (underneath which the oil sand flows) is one of the sides of the confined space. Alternatively, the geometry of the liquid bath is selected such that liquid (without the use of a weir) provides the seal between the space and the confined space.

Preferably, a purge gas is introduced into the confined space. The purge gas may be varied widely and is typically an inert gas. Preferably the purge gas is selected from the group consisting of nitrogen and steam, or a combination thereof. Further it is preferred that the oxygen concentration in the confined space is below a level that creates an explosive or flammable confined space (e.g. as determined by ASTM E2079).

Typically there is at least a slight overpressure in the confined space; preferably, the pressure in the confined space is from 0.001 to 0.35 barg. Further it is preferred that the temperature in the confined space is around ambient temperature, typically from −20 to 100° C., preferably above 0° C., and preferably below 25° C. The same temperatures are typical for the space above the surface of the liquid bath if the space is not confined.

In step (f) bitumen is extracted from the screened oil sand slurry as obtained in step (c). The person skilled in the art will readily understand how to do this; hence, this is not further discussed here in detail. If desired, further non-aqueous solvent may be added to assist in the bitumen extraction.

BRIEF DESCRIPTION OF THE FIGURES

Hereinafter the invention will be further illustrated by the following non-limiting drawing. Herein shows.

For the purpose of this description, a single reference number will be assigned to a line as well as a stream carried in that line.

DETAILED DESCRIPTION

Figure 1:
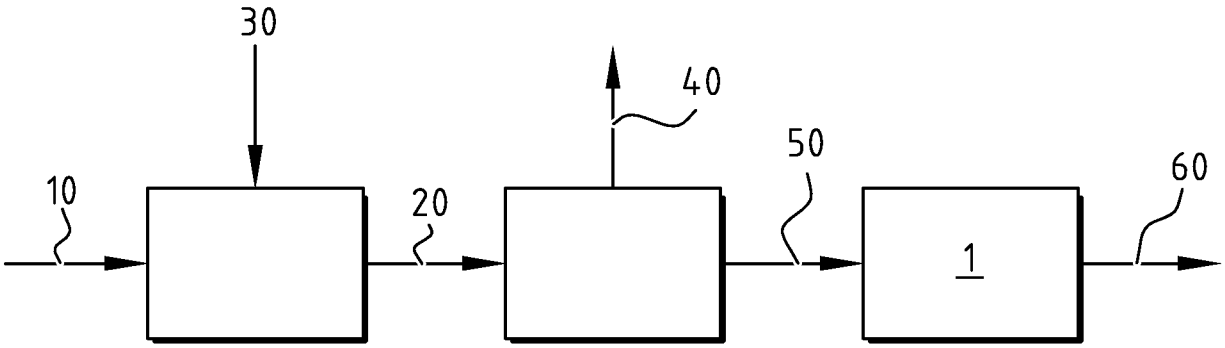
FIG. 1 schematically a process scheme of a non-limiting embodiment of a method in accordance with the present invention.

FIG. 1 schematically shows a simplified process scheme according to the present invention for extracting bitumen from an oil sand stream. As shown in the process scheme of FIG. 1, an oil sand stream 10 is provided and contacted with a liquid 30 comprising a non-aqueous solvent (such as pentane) thereby obtaining a solvent-diluted oil sand slurry 20. The solvent-diluted oil sand slurry 20 is subsequently screened thereby obtaining a screened oil sand slurry 40 and a (non-aqueous solvent wet) rejects stream 50. The screened oil sand slurry 40 is processed further to extract the bitumen (as the person skilled in the art would know how to further process such a screened oil sand slurry, this is not further discuss here in detail).

The (non-aqueous solvent wet) rejects stream 50 is processed to remove the non-aqueous solvent therefrom by introducing it into and transporting through a liquid bath (which will be discussed in more detail whilst referring to FIG. 2; in the scheme of FIG. 1 this step has been generally referred to with reference number 1). Subsequently, the rejects are removed as (non-aqueous solvent-depleted) stream 60, which stream 60 can be further processed, if desired, and/or used for e.g. land reclamation purposes.

Figure 2:
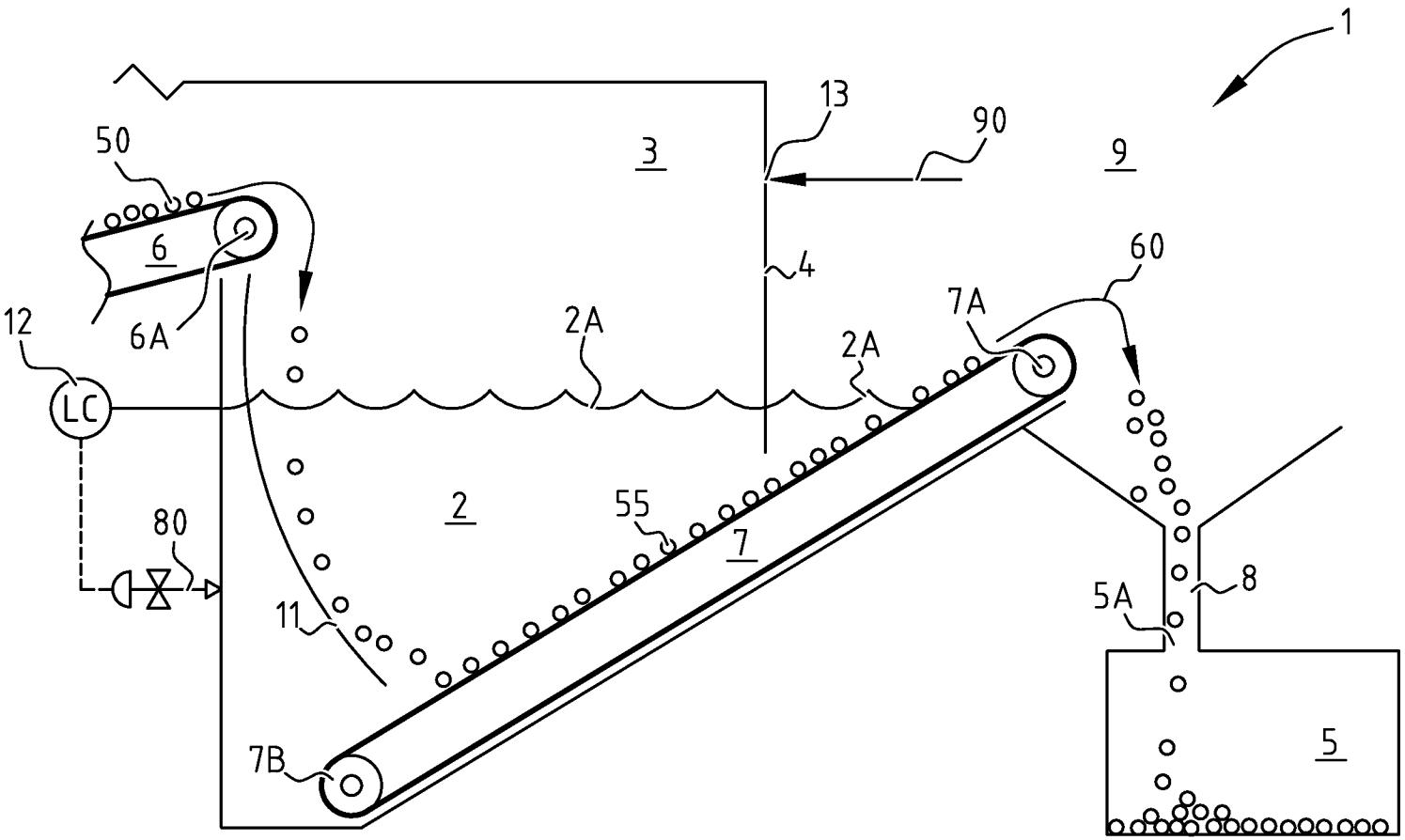
FIG. 2 schematically an example of how the rejects stream can be processed according to the present invention.

FIG. 2 schematically shows an example of how the rejects stream as obtained in step (c) can be processed according to the present invention. The line-up of FIG. 2 is generally referred to with reference number 1. The line-up 1 shows a water bath 2, a confined space 3 above the water bath 2, a weir 4, a collector 5, and two conveyor belts 6 and 7. In the embodiment of FIG. 2 the part upstream of the weir 4 is contained (in the shown embodiment by the water bath 2, the weir 4 and further walls). After passing through the water bath 2 the (non-aqueous solvent-depleted) rejects 60 appear above the water bath 2 and into the space 9 above the water bath 2 (in this embodiment the atmosphere), and are further processed as stream 60. The water bath 2 provides for a seal between the confined space 3 and the atmosphere 9, i.e. there is no open connection between the confined space 3 and the space 9 allowing free exchange of gases between the confined space 3 and space 9. Of course, if desired, gases (such as purge gas 90) may be injected on purpose into the confined space 3.

During use of the process scheme of FIG. 2, a rejects stream 50 is provided via conveyor belt 6 and is introduced from the confined space 3 into the water bath 2. The temperature of the water bath 2 is higher than the non-aqueous solvent causing the non-aqueous solvent to 'flash' or vaporize into the confined space 3. The length of the conveyor belt 7 is selected such that essentially all non-aqueous solvent is removed from the rejects 55 prior to passing under the weir 4.

In the embodiment of FIG. 2, the rejects simply fall from the end 6A of the conveyor belt 6 (via guide plate 11) into the water bath 2 and sink to the bottom thereof, onto the conveyor belt 7. Then, the rejects are transported as stream 55 by the conveyor belt 7 towards the space 9 (in this embodiment the atmosphere) located above the surface 2A of the water bath 2, at the opposite side of the weir 4 (when seen from the confined space 3). In the embodiment of FIG. 2, the rejects 55 are transported through the water bath 2 in an upwards direction to the space 9, i.e. from the lower end 7B to the upper end 7A of the conveyor belt 7, whilst flowing underneath the weir 4 (which is partially submerged in the water bath 2).

Subsequently, the (non-aqueous solvent-depleted) rejects 60 are removed from the space 9 and sent to a further processing step, if desired. To this end, in the embodiment of FIG. 2, the rejects drop off the upper end 7A of the conveyor belt 7 as stream 60 and fall into a chute 8 connected to the inlet 5A of the collector 5. Instead of using the collector 5, the rejects may be disposed of directly, e.g. by using in land reclamation. If desired, the rejects may be dried further before entering the inlet 5A of the collector 5.

Further shown in FIG. 2 is a level control 12 to control the liquid level in the water bath 2; if needed make-up liquid 80 may be added to the water bath 2 to ensure that the liquid level of the water bath 2 remains above the lower end of the weir 4, thereby preserving the seal for the confined space 3.

Also, FIG. 2 shows the introduction of a purge gas 90 (such as nitrogen, steam or flue gas) at inlet 13 into the confined space 3 to drive any evaporated non-aqueous solvent to upstream of the confined space 3. The line-up 1 also has an outlet (not shown) for the non-aqueous solvent (typically connected to some kind of a recovery unit). Further, steam may be injected (not shown) into the water bath 2 to control the temperature of the water bath 2 at a level above the atmospheric boiling point of the non-aqueous solvent.

The confined space 3 is preferably connected to an $O_2$-sensor (not shown) to measure the oxygen concentration in the confined space 3 (which oxygen concentration should remain under a predetermined value).

As some of the rejects might be lighter than the liquid (which may be water as in the shown embodiment or an alternative liquid) as used in the liquid bath 2, and hence would not sink to the bottom of the liquid bath 2, a device may be included that removes these floating rejects from the liquid bath 2. Such device may e.g. be a scraper or pusher. Instead, a liquid outlet (not shown) of the liquid bath 2 may be dimensioned such that the floating rejects will simply leave the liquid bath 2 with the excess liquid. An additional processing step may be considered, if desired, to remove any bitumen or solvent still present on these floating rejects or, alternatively, these floating rejects may be reduced in size and recycled to the screen (not shown) as used in the screening step such that they can be processed together with the screened slurry.

The person skilled in the art will readily understand that many modifications may be made without departing from the scope of the invention.

What is claimed is:

1. A method for extracting bitumen from an oil sand stream, the method comprising at least the steps of:

(a) providing an oil sand stream;

(b) contacting the oil sand stream with a liquid comprising a non-aqueous solvent thereby obtaining a solvent-diluted oil sand slurry;

(c) screening the solvent-diluted oil sand slurry thereby obtaining a screened oil sand slurry and a rejects stream;

(d) introducing the rejects stream into a water bath from a confined space;

(e) transporting the rejects stream through the water bath to a space above the surface of the water bath, wherein the space above the water bath is the atmosphere and the rejects stream is transported through the water bath under a weir, the weir separating the confined space from the atmosphere; and (f) extracting bitumen from the screened oil sand slurry obtained in step (c).

2. The method according to claim 1, wherein the non-aqueous solvent comprises an aliphatic hydrocarbon.

3. The method of claim 2 wherein the aliphatic hydrocarbon has from 3 to 9 carbon atoms per molecule.

4. The method of claim 3 wherein the aliphatic hydrocarbon has from 4 to 7 carbons per molecule.

5. The method according to claim 1, wherein the rejects stream as obtained in step (c) has a particle size of above 5 mm.

6. The method according to claim 1, wherein the rejects stream as obtained in step (c) has a particle size of above 10 mm.

7. The method according to claim 1, wherein the water bath has a temperature of above the atmospheric boiling point of the non-aqueous solvent.

8. The method according to claim 1, wherein the non-aqueous solvent is at least partially removed from the rejects stream, before entering the rejects stream into the liquid bath in step (d).

9. The method according to claim 1, wherein in step (e) the rejects stream is transported in an upwards direction.

10. The method according to claim 1, wherein the pressure in the confined space is from 0.001 to 0.35 barg.

11. The method according to claim 1, wherein the temperature in the confined space is from −20° C. to 100° C.

* * * * *